US008133082B2

(12) United States Patent
Ludwig

(10) Patent No.: US 8,133,082 B2
(45) Date of Patent: Mar. 13, 2012

(54) ELECTRICAL CONDUCTOR AND METHOD FOR MANUFACTURING AN ELECTRICAL CONDUCTOR

(75) Inventor: Ronny Ludwig, Bodelshausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/584,909

(22) Filed: Sep. 14, 2009

(65) Prior Publication Data

US 2010/0112874 A1 May 6, 2010

(30) Foreign Application Priority Data

Oct. 14, 2008 (DE) ..... 10 2008 042 824

(51) Int. Cl.
*H01R 13/02* (2006.01)

(52) U.S. Cl. ..... 439/886

(58) Field of Classification Search ..... 439/886
See application file for complete search history.

(56) References Cited

U.S. PATENT DOCUMENTS

| | | | | |
|---|---|---|---|---|
| 6,627,329 | B1 * | 9/2003 | Shintani | 428/624 |
| 6,848,955 | B2 * | 2/2005 | Kojima | 439/886 |
| 7,294,028 | B2 * | 11/2007 | Rehbein et al. | 439/886 |
| 7,713,849 | B2 * | 5/2010 | Habib et al. | 438/479 |

FOREIGN PATENT DOCUMENTS

JP 2005223088 * 8/2005

* cited by examiner

*Primary Examiner* — Truc Nguyen
(74) *Attorney, Agent, or Firm* — Kenyon & Kenyon LLP

(57) ABSTRACT

An electrical conductor, e.g., a terminal pin, includes a conductor body, a first layer at least partially applied to the conductor body, and a second layer at least partially applied to the first layer, the material of the second layer containing thiol, and the material of the first layer containing nickel.

6 Claims, 3 Drawing Sheets

ELECTRICAL CONDUCTOR AND METHOD FOR MANUFACTURING AN ELECTRICAL CONDUCTOR

BACKGROUND OF THE INVENTION

1. Field of the Invention

The present invention relates to an electrical conductor, e.g., a terminal pin.

2. Description of Related Art

Electrical conductors, e.g., terminal pins, are generally known. For example, a press-in contact pin made of an electrically conductive material for pressing into a hole of a printed circuit board is known from the published German patent document DE 198 31 672 A1. Furthermore, a passivator and a lubricant for gold, silver, and copper surfaces are known from the published German patent application document DE 10 2005 047 843 A1, the passivating agent and lubricant containing thiol.

BRIEF SUMMARY OF THE INVENTION

The electrical conductor and the method for manufacturing an electrical conductor according to the present invention have the advantage over the related art that the friction of nickel-plated electrical conductors is reduced with the aid of thiol. The electrical conductor according to the present invention thus combines the advantages of a nickel alloy with the advantages of a thiol coating. This is advantageous in particular because nickel coatings may be produced, for example, in electrochemical processes, in a comparatively cost-effective and simple manner compared to other metallic coatings. In addition, thiol in the second layer advantageously prevents cold welding when an electrical conductor is pressed into a contact hole, for example, when a press-in contact of the terminal pin is pressed into a printed circuit board hole within a leadless PC board press-in technique. Furthermore, due to the reduced friction, both the press-in forces and the scatter of the press-in forces when the nickel-plated electrical conductors are pressed in are reduced, so that, on the one hand, the risk of damage to the PC board contacts or of the nickel alloy when pressing in is reduced and, on the other hand, better process monitoring is made possible. The reduction in scatter also offers the advantage that leveling of the press-in forces over a plurality of terminal pins and/or press-in contacts of different designs is achieved and thus the manufacturing process of these terminal pins and/or press-in contacts of different designs may be made uniform and thus more cost-effective in particular. In particular, the electrical conductor according to the present invention is used in the automobile industry to advantage, since here comparatively large numbers of electrical conductors are used, making the cost advantage in producing nickel alloys comparatively great. The conductor body is optionally coated only partially using the first layer and/or the first layer is coated only partially using the second layer. The second layer preferably includes a thiol monolayer.

According to an example embodiment, it is provided that the material of the first layer contains 1-octadecanethiol ($C_{18}H_{38}S$). Therefore, it is particularly advantageous that the layer is comparatively heat-resistant. This makes a comparatively broad field of applications of the electrical conductor possible, in particular in the automobile industry, such as for example near the engine of a vehicle. Furthermore, this enables direct extrusion-coating of the electrical conductor using a molding compound for obtaining a casing, where comparatively high temperatures occur. Alternatively, the first layer contains a $C_{10-22}$ alkyl thiol. As used in the context of the present invention, the term $C_{10-22}$ alkyl thiol includes acyclic saturated hydrocarbon radicals, which may be branched or unbranched and have 10 to 22 C atoms. Preferably an alkyl from the group consisting of decylthiol, undecylthiol, dodecylthiol, tridecylthiol, tetradecylthiol, pentadecylthiol, hexadecylthiol, heptadecylthiol, octadecylthiol, nonadecylthiol, icosylthiol, henicosylthiol, and docosylthiol is selected. Preferred is octadecylthiol.

According to an example embodiment, it is provided that the material of the conductor body contains copper, preferably bronze, and particularly preferably $CuSn_6$. Alternatively, it is furthermore provided that the material of the conductor body contains $CuSn_4$ or $CuSn_8$. By using the above-mentioned materials as the conductor body, particularly advantageously a comparatively cost-effective manufacture of the conductor body using standard manufacturing methods is possible. At the same time, a comparatively good electrical conductivity of the electrical conductor is ensured.

According to an example embodiment, it is provided that the electrical conductor is situated, at least partially, in a casing, in particular in a molded casing. The electrical conductor is therefore particularly advantageously usable for contacting PC boards and/or components situated in molded casings in particular. Particularly advantageously, direct extrusion-coating of the electrical conductor with the molding compound is possible using a comparatively refractory thiol such as 1-octadecanethiol without damage to the second layer occurring due to the comparatively high temperatures during the molding process.

According to an example embodiment, it is provided that the electrical conductor includes a press-in contact and a plug contact, the press-in contact being preferably situated within the casing, and the plug contact being situated outside the casing. Therefore, particularly advantageous is, for example, a printed circuit board situated within the casing which may be electrically contacted with the aid of the press-in contacts, the press-in contacts being preferably pressed into through-plated holes in the printed circuit board and there being clamped to electrically conductive elements. The printed circuit board is, in this case, electrically connectable from outside the casing with the aid of a plug, which is plugged into the plug contact, for example. Particularly preferably, the casing has a bulge in the form of a socket surrounding the plug contact, so that a plug or a counterplug may be directly pushed onto the plug contacts, forming an at least partially positive and/or non-positive connection with the socket. In a particularly preferred specific embodiment, it is provided that the second layer is only provided in the area of the press-in contact and/or the plug contact on the first layer.

In a method according to the present invention for manufacturing an electrical conductor, the one conductor body is provided in a first method step, the first layer is applied to the conductor body in a second method step, and the second layer is applied to the first layer in a third method step. The electrical conductor is therefore particularly advantageously manufacturable in a comparatively cost-effective manner and using comparatively well-controllable standard manufacturing methods, the advantages of a nickel alloy of the conductor body being combined with the advantages of a thiol coating in particular. The thiol coating is associated, in particular with a reduction in friction, the reduction in friction on the surface of the electrical conductor due to the second layer being highly advantageous in particular in the further processing of the electrical conductor. For example, the required press-in force for pressing in a press-in contact of the electrical conductor into appropriate holes of a printed circuit board is reduced, so that possible damage to the electrical conductor, in particular to the first layer or to the press-in contact and/or to the printed circuit board, in particular to the holes, is advantageously prevented.

According to an example embodiment, it is provided that in the second method step the first layer is applied to the conductor body by electrochemical deposition, preferably in a band electrodeposition process. The conductor body and/or a composite structure of a plurality of conductor bodies must only be drawn through one electrolytic bath for applying the first layer, so that a plurality of conductor bodies is coated with the first layer comparatively rapidly and cost-effectively, a comparatively uniform alloying of the conductor body being ensured.

According to an example embodiment, it is provided that the second layer is applied to the first layer in an immersion bath in the third method step, so that a comparatively cost-effective coating of the second layer may be advantageously performed in particular. Particularly advantageously, a thiol monolayer, which is resistant to an at least brief comparatively high-temperature exposure, in particular in a subsequent molding process, is applied to the first layer in the third method step, at least partially, i.e., in the area of the press-in contacts. This is highly important, in particular due to the fact that the conductor body usually has a comparatively high thermal conductivity and therefore the electrical conductor is heated to a comparatively high temperature, for example, in a subsequent molding process.

According to an example embodiment, it is provided that in a fourth method step the electrical conductor is extrusion-coated using a molding compound for producing the casing, so that particularly advantageously electrical contacting of printed circuit boards within the casing and/or from outside the casing is implementable in a comparatively cost-effective manner. In particular, electrically conductive connections between a plug outside the casing and a printed circuit board within the casing are implementable in a cost-effective manner.

According to an example embodiment, it is provided that in the first method step a composite structure of a plurality of conductor bodies is provided, so that, particularly advantageously, a plurality of electrical conductors is manufacturable essentially simultaneously and/or in a continuously consecutive manner.

According to an example embodiment, it is provided that the conductor body and/or the composite structure is/are manufactured by a stamping, embossing, and/or pressing method in a fifth method step performed chronologically prior to the first method step, and the press-in contact and the plug contact of the conductor body and/or of the conductor bodies of the composite structure is/are produced preferably in the fifth method step. Particularly advantageously, electrical conductors having press-in contacts and/or plug contacts of any shape may thus be mass-produced in a simple and cost-saving manner. Particularly preferably, an electrical conductor has an anchor structure between the press-in contact and the plug contact, which is particularly preferably sheathed by the molding compound when the electrical conductor is extrusion-coated, so that a comparatively stable bond between the electrical conductor and the casing is achieved.

According to an example embodiment, it is provided that in a sixth method step performed chronologically after the third method step electrical conductors are separated from the composite structure, so that a plurality of individual electrical conductors is manufacturable from the composite structure in a simple manner.

DETAILED DESCRIPTION OF THE INVENTION

Figure 1A:
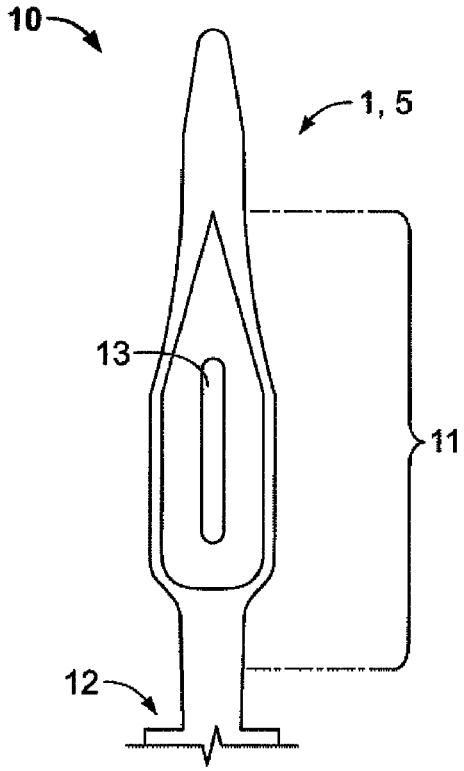
FIGS. 1*a*, 1*b*, and 1*c* schematically show sections of an electrical conductor according to a first example embodiment of the present invention.
Figure 1B:
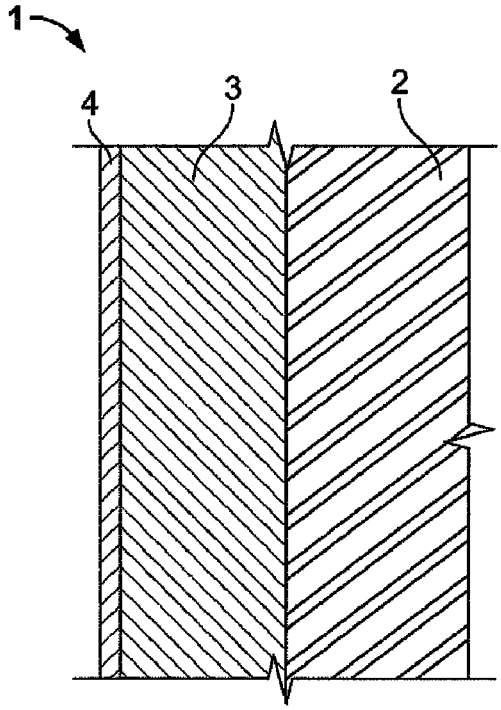
Figure 1C:
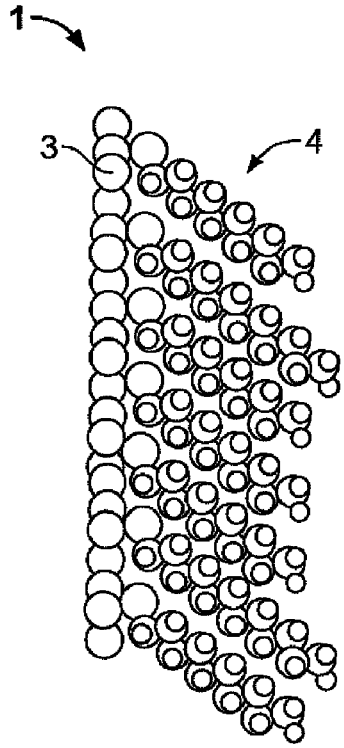

FIGS. 1*a*, 1*b*, and 1*c* schematically show sections of an electrical conductor 1 according to a first example embodiment of the present invention. In FIG. 1*a*, a press-in contact 5 of an electrical conductor 1 according to the first specific embodiment is illustrated as an example, press-in contact 5 having a pin tip 10, an elastic press-in area 11, and an attachment area 12, elastic press-in area 11 being situated between pin tip 10 and attachment area 12 in the axial direction of electrical conductor 1, and has a recess 13 in the middle in the axial direction. Elastic press-in area 11 is pressed together when press-in contact 5 is introduced into a hole, for example, of a printed circuit board (not illustrated) and forms, with a hole wall of the printed circuit board, a form- and friction-locked bond, which is electrically conductive. Tapered pin tip 10 is used as an insertion aid of press-in contact 5. Attachment area 12 of press-in contact 5 is preferably designed in such a way that a maximally stable bond of attachment area 12 to a casing 8 (not illustrated in FIG. 1*a*) is achievable when attachment area 12 is extrusion-coated using a molding compound for forming casing 8 (see FIG. 2).

FIG. 1*b* shows a highly enlarged surface cross section of electrical conductor 1, electrical conductor 1 having a conductor body 2 as a basic body, conductor body 2 preferably containing copper and particularly preferably bronze, and more particularly preferably $CuSn_4$, $CuSn_8$, and/or $CuSn_8$. A first layer 3, in particular in the form of an electrochemically deposited nickel alloy, is applied to conductor body 2. First layer 3 preferably includes a matte or shiny Ni layer, optionally also a double layer such as an Ni sandwich 70/30 (i.e., 30% shiny Ni over 70% matte Ni). A second layer 4, containing thiol, preferably a thiol monolayer and particularly preferably 1-octadecanethiol ($C_{18}H_{38}S$), is at least partially applied to first layer 3, second layer 4 being preferably applied to first layer 3 in an immersion bath. Second layer 4 is particularly preferably applied to electrical conductors 1 at least in the area of press-in contact 5 and has a comparatively good heat resistance, so that, in particular during the molding process for producing casing 8, damage to second layer 4 is prevented.

FIG. 1*c* schematically shows another enlarged depiction of the surface of electrical conductor 1, first and second layers 3, 4, as well as the bond between first and second layers 3, 4 being illustrated on a molecular level as a conceptual illustration.

Figure 2:
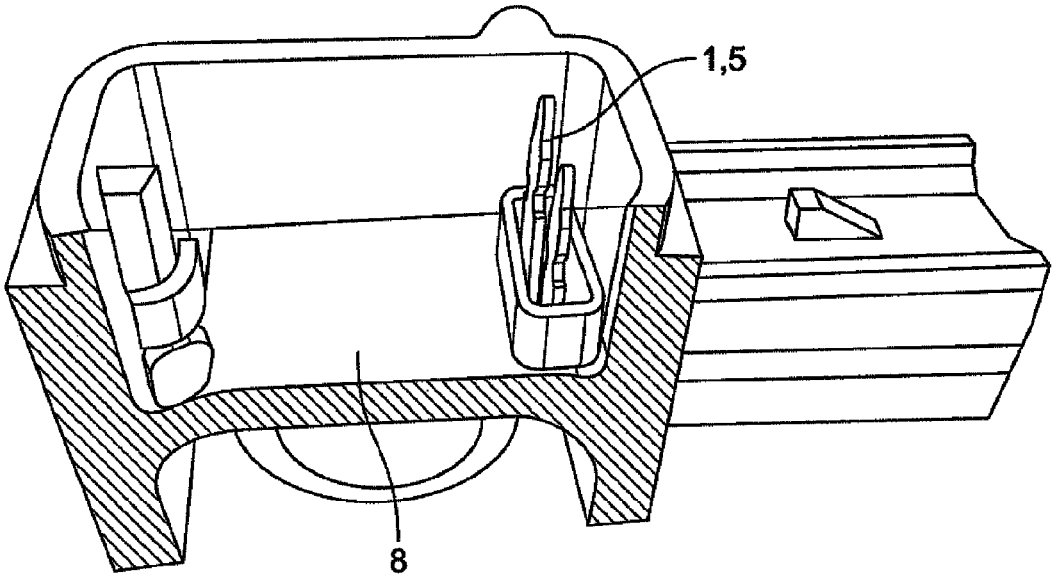
FIG. 2 schematically shows a second example embodiment of the present invention in a perspective view.

FIG. 2 shows a schematic perspective view of an electrical conductor 1 according to a second example embodiment of the present invention. The second example embodiment is essentially depicted identically to the first specific embodiment in FIGS. 1*a*, 1*b*, and 1*c*, electrical conductor 1 being at least partially situated in a casing 8. In particular, press-in contact 5 of electrical conductor is situated within casing 8, so that, for example, a printed circuit board (not illustrated) within casing 8 is electrically contactable via press-in contacts 5, and a plug contact 6 of electrical conductor 1 being situated outside casing 8. In FIG. 2, plug contact 6 is, however, hidden by part of casing 8, which forms a socket around plug contact 6 outside casing 8, so that an external plug (not illustrated) may be directly plugged or pushed into this part of the casing, thereby contacting plug contacts 6. Attachment area 12, which is anchored in the casing wall of casing 8, is preferably situated between press-in contact 5 and plug contact 6. Particularly advantageously, electrical conductor 1 is directly extrusion-coated by a molding compound in a molding process for forming casing 8, the comparatively good heat resistance of second layer 4 preventing damage to second layer 4 by the comparatively high temperatures during the molding process. It is particularly advantageous that casing 8 is formed around a plurality of electrical conductors 1, so that multipole contacting of the printed circuit board is made possible, the plurality of electrical conductors 1 being preferably electrically insulated from each other. FIG. 2 illustrates a casing 8 having two electrical conductors 1 as an example. Casing 8 particularly preferably includes a sensor casing.

Figure 3:
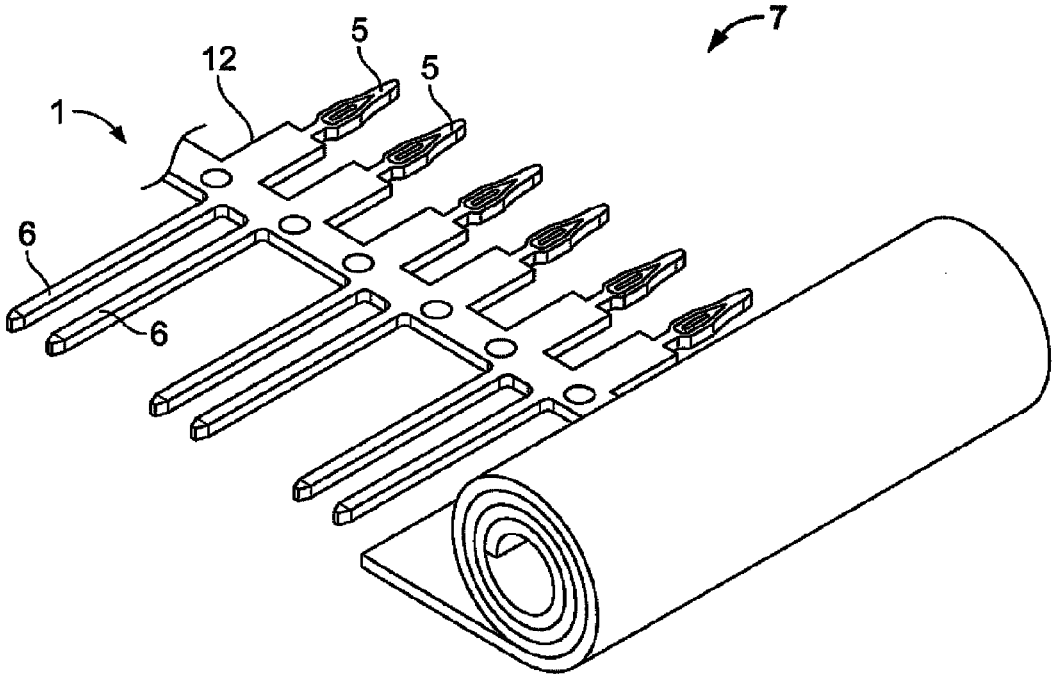
FIG. 3 schematically shows a precursor structure for manufacturing an electrical conductor according to the second example embodiment of the present invention in a perspective view.

FIG. 3 shows a schematic perspective view of a precursor structure 1' for manufacturing an electrical conductor 1 according to the second example embodiment of the present invention, precursor structure 1' being provided in the form of a composite structure 7 made up of a plurality of conductor bodies 2 in a first method step, composite structure 7 being manufactured, in particular in a preceding fifth method step, by a stamping process from a band 1", conductor body 2, together with press-in contact 5, plug contact 6, and attachment area 12 being formed by the stamping process. In a subsequent second method step (not illustrated), first layer 3 is applied to conductor bodies 2 of composite structure 7, preferably in a band electrodeposition process, composite structure 7 being particularly preferably drawn through an electrolytic bath. In a subsequent third method step (not illustrated), second layers 3 of conductor bodies 2 of composite structure 7 are coated with second layer 5 in at least one area of press-in contact 5, preferably in an immersion bath or, particularly preferably, in a mist chamber, so that a thiol monolayer is deposited on first layer 2. Particularly preferably, composite structure 7 is drawn through the immersion bath. In a subsequent sixth method step, electrical conductors 1 are separated from composite structure 7 and, in a subsequent fourth method step for forming casing 8, are thus individually at least partially extrusion-coated using the molding compound. Optionally, composite structure 7 or individual electrical conductors 1 are bent before the fourth method step.

Figure 4A:
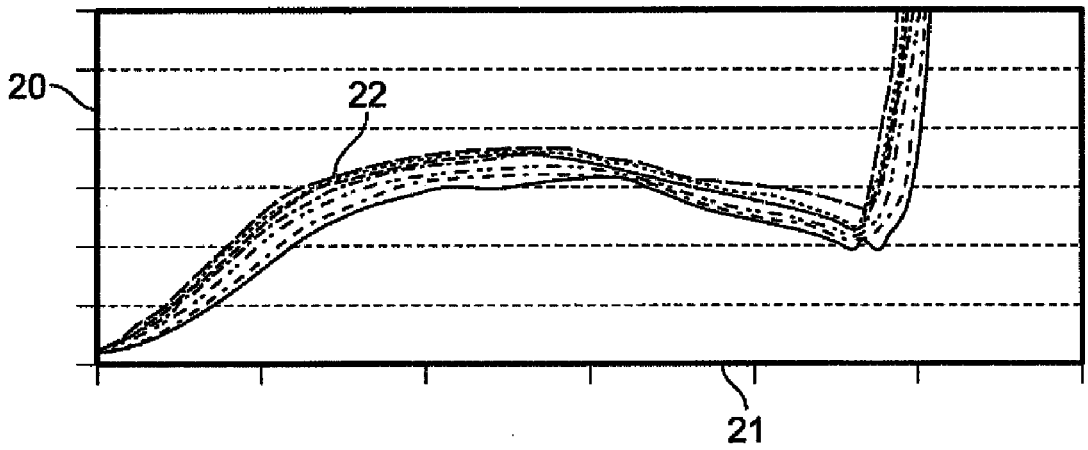
FIGS. 4*a* and 4*b* show two diagrams for illustrating the necessary press-in forces of a press-in contact of an electrical conductor.
Figure 4B:
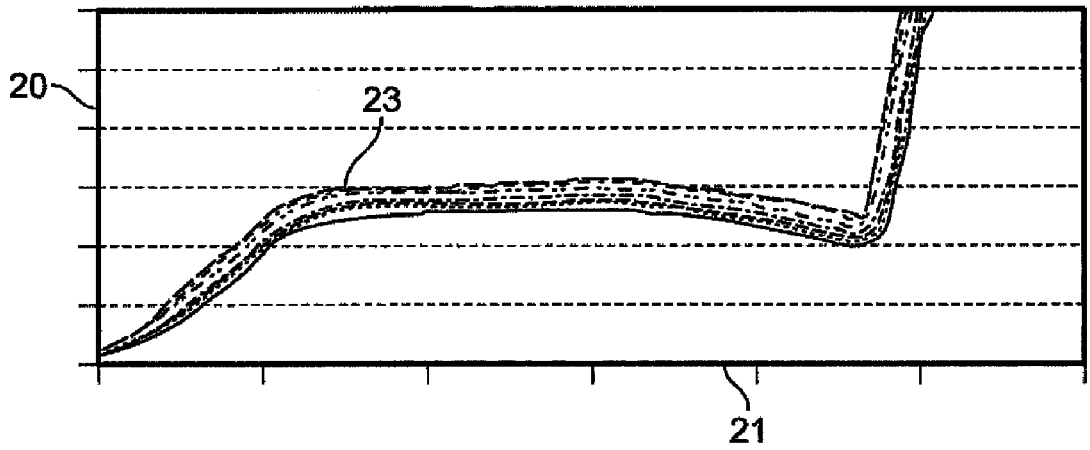

FIGS. 4*a* and 4*b* show two diagrams to illustrate the required press-in forces of a press-in contact 5 of an electrical conductor 1 as a function of a press-in path, the press-in force being shown in Newtons on respective ordinate 20 against the press-in path in millimeters on abscissa 21. FIG. 4*a* illustrates the distribution of first press-in forces 22 against the corresponding press-in path of electrical conductors without coating by second layer 4. For comparison, FIG. 4*b* shows the distribution of second press-in forces 23 against the corresponding press-in paths of electrical conductors 1 according to the present invention, which have at least one coating of press-in contact 5 by second layer 4. It is apparent that, particularly advantageously, both the press-in forces and the scatter of the press-in forces are reduced by second layer 4.

What is claimed is:

1. An electrical conductor configured as a terminal pin, comprising:

a conductor body;

a first layer at least partially applied to the conductor body, wherein the material of the first layer contains nickel; and a second layer at least partially applied to the first layer, wherein the material of the second layer contains thiol.

2. The electrical conductor as recited in claim 1, wherein the material of the first layer contains 1-octadecanethiol.

3. The electrical conductor as recited in claim 2, wherein the material of the conductor body contains copper.

4. The electrical conductor as recited in claim 3, wherein the electrical conductor is at least partially situated in a molded casing.

5. The electrical conductor as recited in claim 4, wherein the electrical conductor includes a press-in contact situated within the casing and a plug contact situated outside the casing.

6. A method for manufacturing an electrical conductor configured as a terminal pin, comprising:

providing at least one conductor body in a first method step;

applying a first layer to the conductor body in a second method step; and applying a second layer to the first layer in a third method step.

* * * * *